US005547061A

United States Patent [19]

Itako et al.

[11] Patent Number: 5,547,061

[45] Date of Patent: Aug. 20, 1996

[54] CURRENCY-IDENTIFYING APPARATUS

[75] Inventors: Eiji Itako, Sakado; Ichiro Fukuda, Kawagoe, both of Japan

[73] Assignee: Nippon Conlux Co., Ltd., Tokyo, Japan

[21] Appl. No.: 354,361

[22] Filed: Dec. 12, 1994

[30] Foreign Application Priority Data

Dec. 27, 1993 [JP] Japan ..... 5-346941

[51] Int. Cl.[6] ..... G07F 7/04

[52] U.S. Cl. ..... 194/203; 194/207; 356/394

[58] Field of Search ..... 194/202, 203, 194/205, 206, 207; 382/135, 136; 356/71, 394

[56] References Cited

U.S. PATENT DOCUMENTS

| | | | |
|---|---|---|---|
| 5,195,739 | 3/1993 | Watabe | 194/203 X |
| 5,199,543 | 4/1993 | Kamagami et al. | 194/207 |
| 5,242,041 | 9/1993 | Isobe | 194/207 |
| 5,325,952 | 7/1994 | McGinley et al. | 194/206 X |
| 5,372,361 | 12/1994 | Isobe et al. | 194/203 X |
| 5,383,546 | 1/1995 | Mulder | 194/203 |

FOREIGN PATENT DOCUMENTS

| | | | |
|---|---|---|---|
| 4021519 | 12/1991 | Germany | 194/207 |
| 62-157990 | 7/1987 | Japan . | |
| 3-214386 | 9/1991 | Japan . | |
| 5-20527 | 1/1993 | Japan . | |

*Primary Examiner*—Karen B. Merritt
*Assistant Examiner*—Scott L. Lowe
*Attorney, Agent, or Firm*—Koda and Androlia

[57] ABSTRACT

An apparatus for identifying a paper currency. Before the front end of the currency is detected by optical sensors, the output signal (DATA1) from the optical sensors is stored in a first storage device. When the rear end of the currency subsequently passes across the sensors and the currency is no longer detected by the sensors, the output signal (DATA3) from the sensors is stored in a second storage device. If any currency-withdrawing device such as cord or tape is not attached to the currency, the DATA1 is equal to the DATA3 because these two kinds of data indicate the state in which nothing is present in the currency conveyance passageway. If such a currency-withdrawing device is attached to the currency, light from light-emitting devices is blocked or reflected by the cord or tape, thus varying the DATA3. However, the DATA1 is not affected. As a result, the DATA1 becomes unequal to the DATA3. In this way, attachment of the withdrawing device to the currency can be detected according to the results of detection made by the optical sensors, i.e., DATA1 and DATA3.

8 Claims, 4 Drawing Sheets

CURRENCY-IDENTIFYING APPARATUS

BACKGROUND OF THE INVENTION

1. Field of the Invention

The present invention relates to improvements in a currency-identifying apparatus capable of effectively detecting a currency-withdrawing means such as tape or cord if it is attached to a paper currency inserted into the currency-identifying apparatus.

2. Description of the Related Art

Unfair practices are sometimes done on currency-identifying apparatus incorporated in vending machines, money changers, and so on. Specifically, tape, cord, or the like is attached to a genuine paper currency. Then, this currency is inserted into the currency-identifying apparatus to cause it to perform processing for judging that the inserted currency is genuine. Thereafter, the currency is withdrawn from the apparatus through its insertion slot by pulling the tape or cord.

One countermeasure against this kind of unfair practice is to provide withdrawal-preventing levers inside the currency passageway in a currency-identifying apparatus. When the front end of a paper currency bears against any one of the levers, it falls only in the direction of insertion of currency, thus permitting passage of the currency. After the passage, the lever is automatically returned to its original position to thereby close off the currency passageway. Under this condition, passage of the paper money is prohibited. Another countermeasure is to provide a detection means for detecting insertion or the position of a paper currency. Either a solenoid or an actuator interlocks with the detecting means to release the currency passageway only for a given time after insertion of the currency.

Further conceivable countermeasures using a driven member such as a gate, shutter, or roller are disclosed in Japanese Patent Laid-Open Nos. 214388/1991, 0527/1993, and 157990/1987, wherein, if tape having a paper currency attached to its front end moves through the currency passageway in a currency-identifying apparatus, the driven member is swung or moved by the moving tape. The swinging or rectilinear movement of the driven member is detected by a detector. In this way, an unfair deed is identified.

However, when an attempt is made to effectively prevent withdrawal of a paper currency by the above-described prior art techniques, it is necessary to mount numerous withdrawal-preventing, projecting levers across the currency conveyance passageway or to mount gate-like levers which cover the whole width of the currency conveyance passageway. For these arrangements, a large number of slits must be formed in the currency passageway. Therefore, paper currencies often stall and other troubles take place frequently.

Where the above-described withdrawal-preventing levers are provided with detection means for sensing that the levers have been returned to their original positions, if a transaction is allowed according to the result of the decision made to judge whether the currency is genuine or false after closure of a paper currency passageway by the levers is confirmed, and if tape or cord of poor rigidness is attached to the inserted paper currency, then the tape or cord is bent and the withdrawal-preventing levers are returned to their original positions. As a result, there arises the possibility that a transaction similar to a transaction which would be done if a genuine currency is inserted correctly is effected while the tape or cord remains attached to the currency. After the transaction, the levers are urged to move up by the tape or cord. Hence, the pullout of the paper currency cannot be prevented.

Where the withdrawal-preventing levers or the driven member such as a gate, a shutter, or a roller is provided in the currency passageway, the structure of the currency-identifying apparatus is made complex. In addition, the passageway is narrowed or bent. In consequence, passage of paper currencies across this location is hindered, or they often stall.

OBJECTS AND SUMMARY OF THE INVENTION

It is an object of the present invention to provide a currency-identifying apparatus equipped with a means which judges whether cord or tape is attached to the paper currency inserted into the apparatus by means of optical sensors and which, if the absence of such cord or tape is confirmed, permits the currency to be changed into coins or allows an article to be delivered.

According to the present invention, as schematically shown in FIGS. 6(A) and 6(B), a light-emitting device S2*a* and a light-receiving device S2*b* of an optical sensor S2 are disposed on opposite sides of a currency passageway bp. As shown in FIG. 6(A), when a paper currency bi moving forwardly (in the direction indicated by the arrow) through the currency passageway bp does not yet reach the optical sensor, data DATA1 about the light received by the light-receiving device S2*b* is obtained. Then, as shown in FIG. 6(B), after the currency bi has passed across the position of the light-receiving device S2*b*, data DATA3 about the light received by the light-receiving device S2*b* is obtained.

If neither cord nor tape is attached to the paper currency bi, then the relation DATA1 =DATA3 should hold. However, if a cord or tape st is affixed to the currency bi, as shown in FIGS. 6(A) and 6(B), then the data DATA1 about the light received by the light-receiving device S2*b* is not affected by the cord or tape st under the condition illustrated in FIG. 6(A). However, under the condition illustrated in FIG. 6(B), the data DATA3 about the light received by the light-receiving device S2*b* is affected by the cord or tape st. Thus, the DATA1 is not equal to the DATA3. In this way, the cord or tape st can be detected.

Other objects and features of the invention will become apparent from the description thereof, which follows.

DESCRIPTION OF THE PREFERRED EMBODIMENTS

Figure 2:
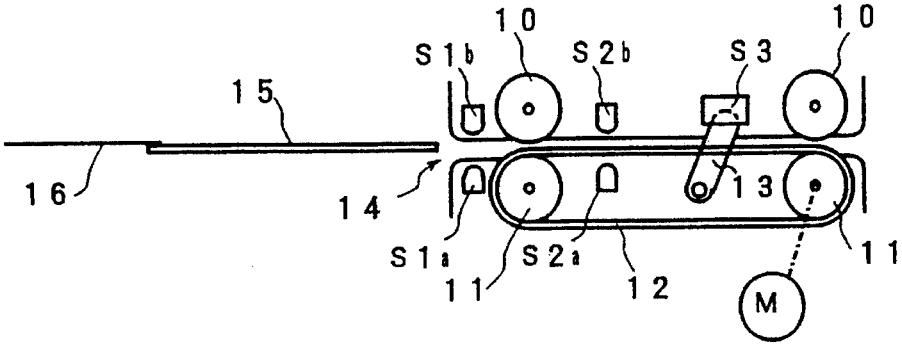
FIG. 2 is a fragmentary side elevation of a currency-identifying apparatus according to the invention, the apparatus being controlled by the control system shown in FIG. 1.
Figure 3:
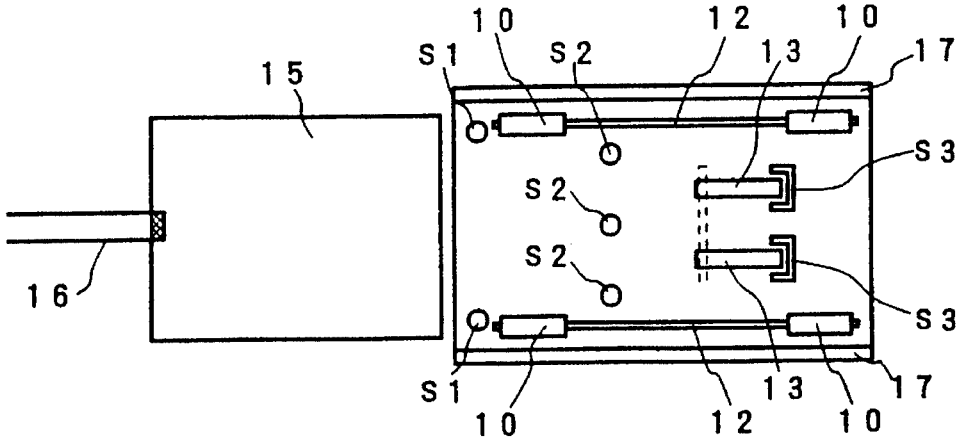
FIG. 3 is a plan view of the currency-identifying apparatus shown in FIG. 2.

Referring to FIGS. 2 and 3, there is shown a currency-identifying apparatus embodying the concept of the present invention. This apparatus comprises driving conveyor rollers 11 mounted to the opposite ends, respectively, of two horizontally extending shafts, follower conveyor rollers 10 mounted to the opposite ends, respectively, of two horizontally extending shafts, and a currency conveyance passageway 14 extending horizontally. The follower conveyor rollers 10 and the driving rollers 11 are mounted above and below the passageway 14 having a given width, respectively. One of the shafts having the driving rollers 11 mounted at their opposite ends is rotated by an electric motor M. Rotation of the driven shaft is transmitted to the other shaft via timing belts 12 which are trained between their respective driving rollers 11. The follower rollers 10 are pressed against these timing belts 12 by biasing means such as springs.

Figure 1:
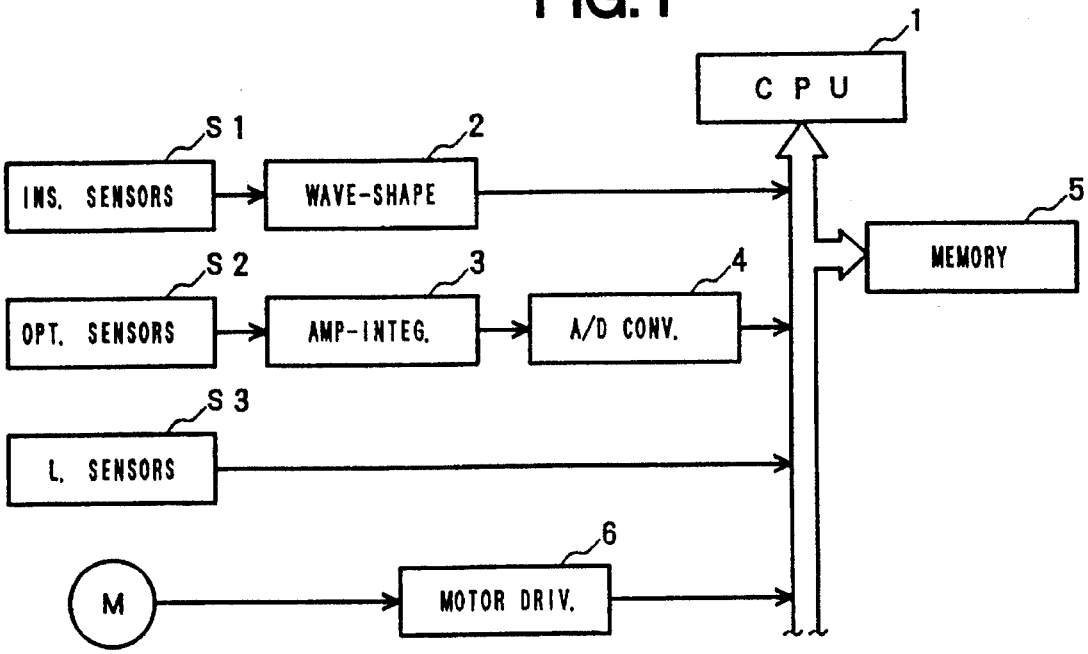
FIG. 1 is a schematic block diagram of a control system for use with a currency-identifying apparatus according to the present invention.

As shown in FIG. 1, if the motor M is driven via a motor driver circuit 6 under an instruction from a microprocessor (CPU) 1, a paper currency 15 is held between the timing belts 12 and two pairs of the follower rollers 10 and fed in a forward direction, i.e., to the right as viewed in FIGS. 2 and 3.

A dark-ON type currency insertion-detecting sensor S1 consisting of a light-emitting device S1*a* and a light-receiving device S1*b* is mounted near the entrance to the currency conveyance passageway 14. The devices S1*a* and S1*b* are disposed on vertically opposite sides of the passageway 14. If the front end of the currency 15 passes through the entrance to the currency conveyance passageway 14 and blocks the light coming from the light-emitting device S1*a*, then the output signal from the light-receiving device S1*b* is processed by a wave-shaping circuit 2, which then informs the microprocessor 1 that a paper currency has been inserted in the conveyance passageway 14.

Plural optical sensors S2 are spaced slightly downstream from the positions of the currency insertion-detecting sensors S1 inside the passageway 14 in the direction of insertion of paper currency. Each optical sensor S2 consists of a light-emitting device S2*a* and a light-receiving device S2*b* which are mounted on vertically opposite sides of the currency conveyance passageway 14. In the example shown in FIG. 3, the number of the optical sensors S2 is three, and they are equally spaced from each other across the conveyance passageway 14.

Each optical sensor S2 acts as a currency information detection means for extracting information intrinsic to the paper currency 15 and also as a currency passage detector for sensing that a currency has passed. In order to extract the information intrinsic to the currency 15, each optical sensor S2 detects the transmissivities of various portions of the currency 15 for light by detecting either varying concentrations of patterns on the currency or the colors of dots arranged in rows. Each optical sensor S2 is required to certainly detect tape or cord if it is attached to the currency, as described in greater detail below. Therefore, as shown in FIG. 1, the output signal from each optical sensor S2 is processed by an amplification-and-integration circuit 3 and by an A/D converter 4 and then sent to the microprocessor 1. The provision of the amplification-and-integration circuit permits detection of subtle variations in transmissivity caused by the presence or absence of tape or cord.

As shown in FIG. 3, two rodlike withdrawal-preventing levers 13 are spaced further downstream from the position of each optical sensor S2 within the currency conveyance passageway 14 in the direction of insertion of currency. The levers 13 are biased to protrude into the passageway 14 by biasing means such as springs, as shown in FIG. 2. When the paper currency 15 is transported in the direction of insertion of currency, i.e., in the rightward direction as viewed in FIG. 2, if the front end of the currency 15 bears against the levers 13, then the levers 13 fall and are moved out of the conveyance passageway 14. Consequently, passage of the currency 15 is not obstructed. If the currency 15 moves past the withdrawal-preventing levers 13, the levers are returned to their original positions by the biasing means.

On the other hand, if the paper money 15 is moved through the conveyance passageway 14 in the direction opposite to the direction of insertion of currency, and if the front end of the currency 15 bears against the levers 13, then the levers are actuated so as to close the passageway 14. Hence, the currency 15 is prevented from moving past the withdrawal-preventing levers 13.

As shown in Fig. S, the withdrawal-preventing levers 13 are not aligned with the optical sensors S2. Their lateral positions as viewed laterally of the currency passageway are midway between the successive sensors S2, for the following reason. If cord or tape is located between adjacent ones of the optical sensors S2 and thus the cord or tape can be detected by none of the optical sensors, the levers 13 located downstream in the direction of transportation assure that the currency is prevented from being pulled out. If the spacing between the side wall of the passageway and the outermost optical sensor of these sensors S2, which are closest to the side wall, is considerably large, then additional withdrawal-preventing levers 13 aligned with the midway positions between the outermost optical sensors S2 and the side wall are mounted.

The apparatus recognizes that the paper currency 15 has normally arrived at the final position in the currency conveyance passageway and that withdrawal has been already made unfeasible, by confirming that the levers 13 are in their original positions, as described later. Means for sensing that they are in their original positions are described below.

Each withdrawal-preventing lever 13 is equipped with a lever sensor S3 for checking that the lever has been returned to its original position. This lever sensor S3 consists of a combination of a light-emitting device and a light-receiving device which are mounted on opposite sides of the front end of the lever 13 when it is in its original position. If the lever sensor S3 is in the original position, light emitted from the light-emitting device is blocked by the withdrawal-preventing lever 13 and then the light-receiving device sends an OFF signal to the microprocessor 1. On the other hand, if the lever 13 falls by dint of the currency 15 to permit the light from the light-emitting device to reach the light-receiving device, the light-receiving device sends an ON signal to the microprocessor 1. Moreover, when the lever 13 is prevented from returning to the original position after the passage of the currency due to the presence of a tape or cord attached to the currency, the lever 13 cannot prevent the light from the light-emitting device to reach the light-receiving device.

The microprocessor 1 which constitutes the main portion of the control system for the currency-identifying apparatus is connected with a memory 5 via a bus. This memory 5 includes a ROM in which a control program for driving the currency-identifying apparatus and for judging paper currencies is stored. Moreover, the memory 5 includes a RAM for temporarily storing data obtained by detection.

Figure 4:
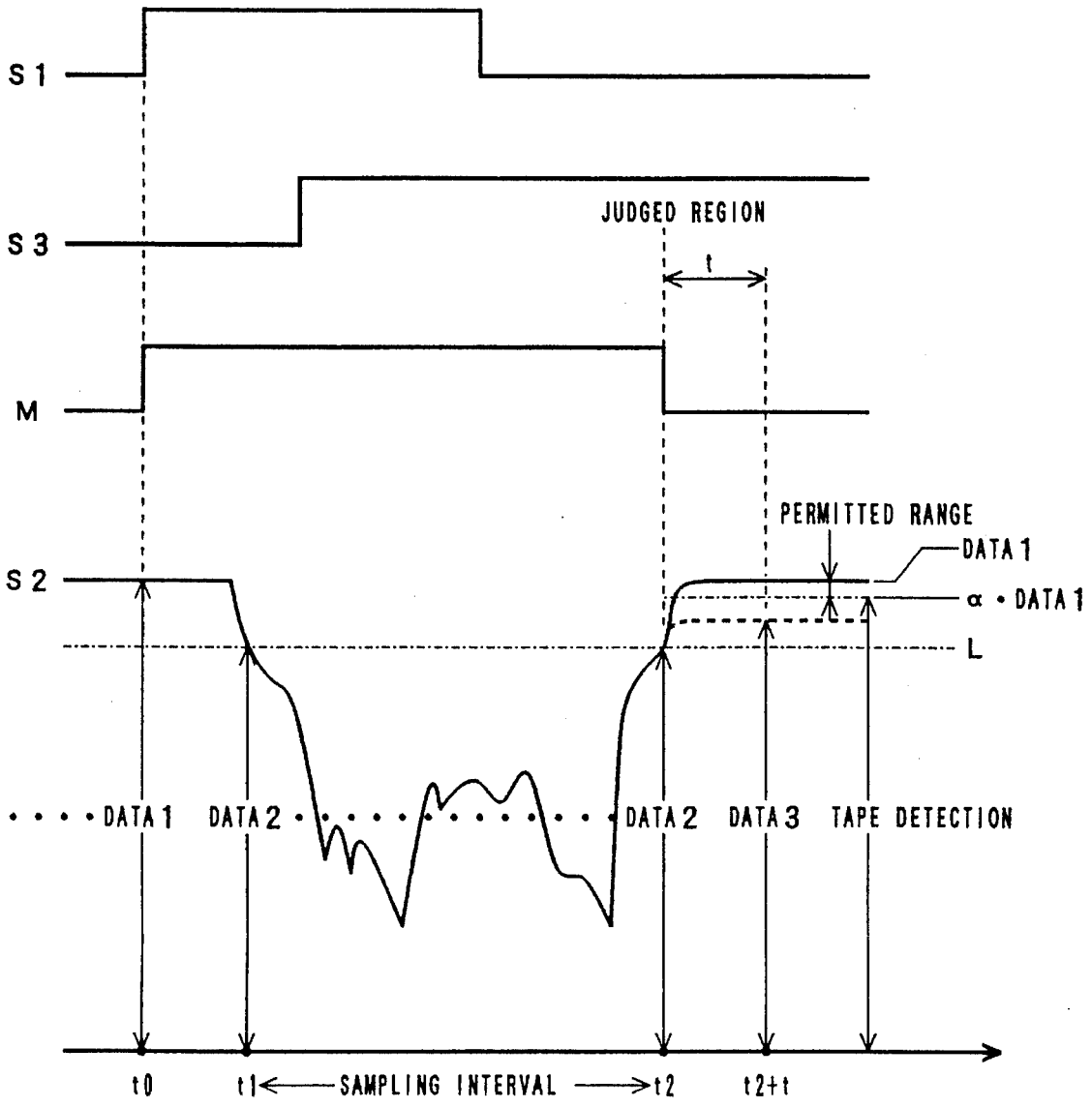
FIG. 4 is a timing chart schematically illustrating processing performed by the currency-identifying apparatus shown in FIG. 2.
Figure 5:
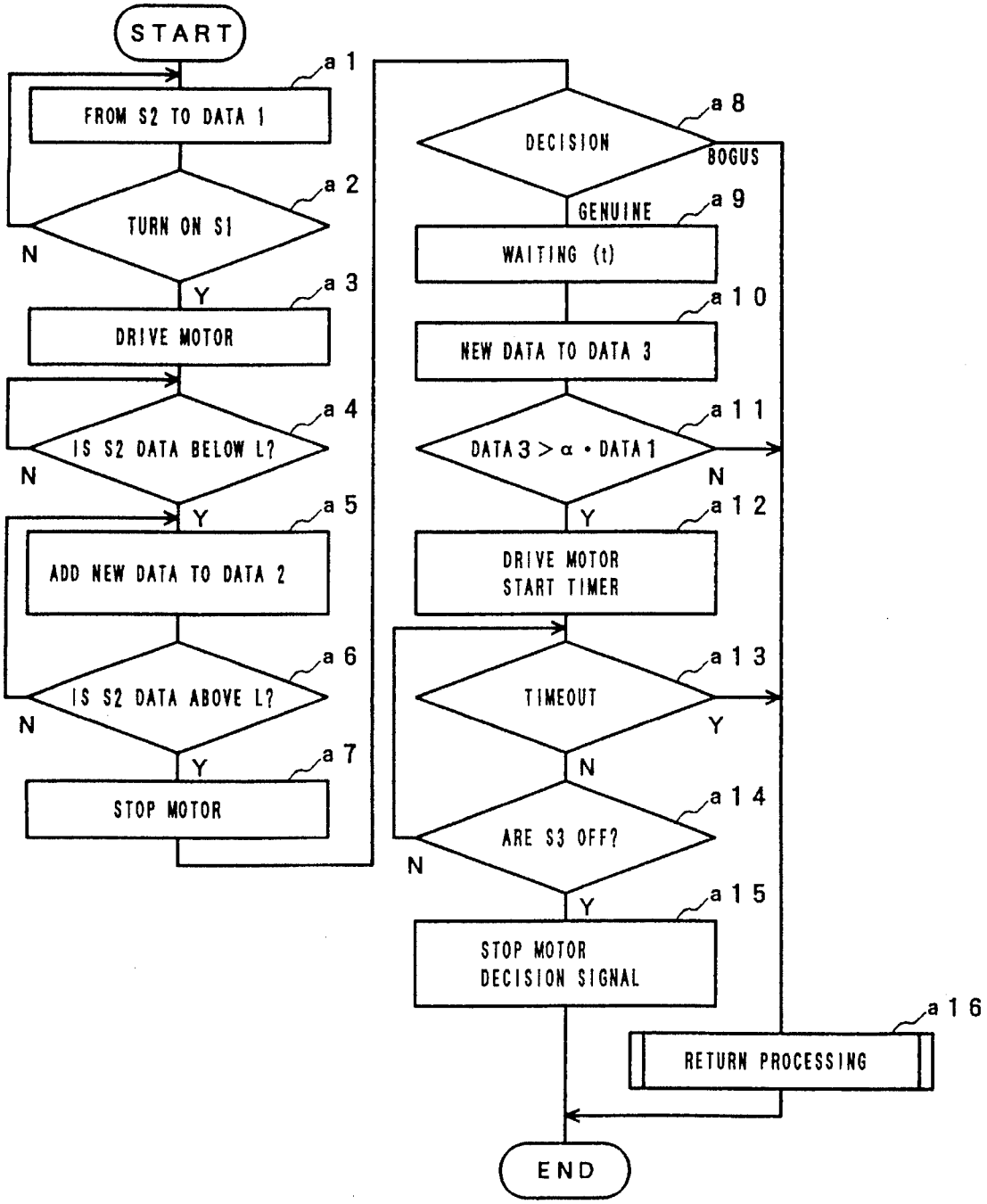
FIG. 5 is a flowchart schematically illustrating the processing performed by the currency-identifying apparatus shown in FIG. 2.
Figure 6A:
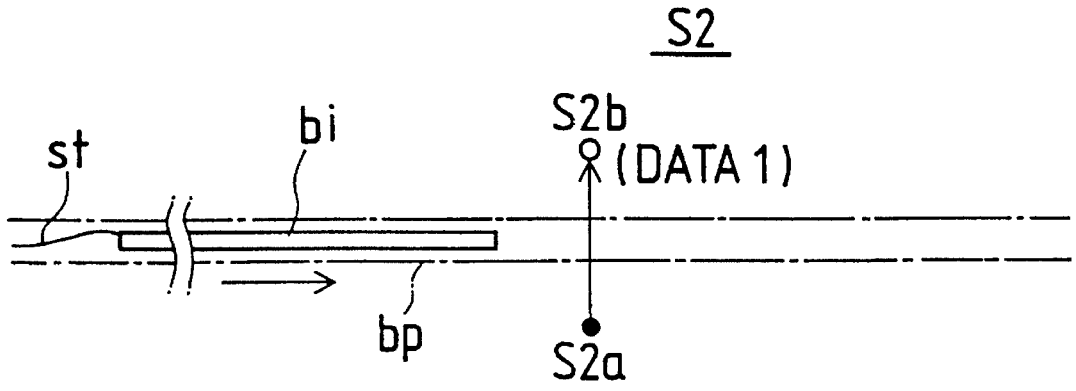
FIGS. 6(A) and 6(B) are schematic diagrams illustrating a means for sensing that tape or cord is attached to a paper currency, the means being incorporated in the currency-identifying apparatus shown in FIGS. 2 and 3.
Figure 6B:
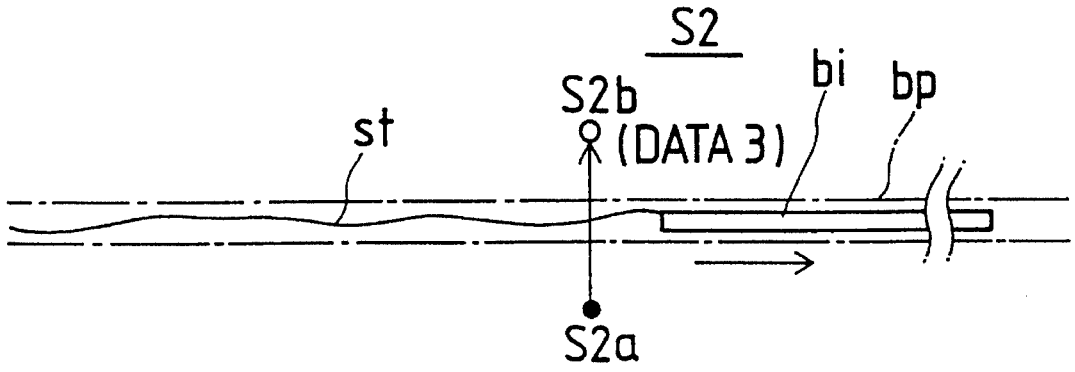

FIG. 5 is a flowchart schematically illustrating processing performed by the microprocessor 1 of the currency-identifying apparatus according to the control program stored in the ROM of the memory 15. FIG. 4 is a timing chart illustrating the timing at which the sensors S1, S2, S3, and the motor M are operated during this processing. The operation of the currency-identifying apparatus in the present invention is now described by referring to FIGS. 5 and 4 and using the configuration already described.

If the power supply of the currency-identifying apparatus is turned on, the microprocessor 1 accepts successive data items from the optical sensors S2 until a signal indicating detection of a paper currency is applied from the currency insertion-detecting sensors S1. The data items from the optical sensors S2 are processed by the amplification-and-integration circuit 3 and by the A/D converter 4 and are successively stored in a DATA1 register (first information storage means) in the memory 5. In this way, the contents of the register are updated (step a1).

If a paper currency 15 is then manually inserted into the currency conveyance passageway 14 in the currency-identifying apparatus by a user, then the insertion-detecting sensors S1 detect the inserted currency (step a2). The microprocessor 1 stops the data from the optical sensors S2 from being written to the DATA1 register and drives the motor M in a forward direction, thus initiating conveyance of the currency (step a3) at the timing to illustrated in FIG. 4. Data held in the DATA1 register in this stage is an output signal produced from the optical sensors S2 (S2*a*, S2*b*) immediately before the front end of the currency 15 arrives at the positions of the insertion-detecting sensors S1 (S1*a*, S1*b*).

Rotation of the motor M causes the paper currency 15 to be transported through the conveyance passageway 14. If the front end of the currency reaches the positions at which the optical sensors S2 are positioned, the light from the light-emitting devices S2*a* of the optical sensors S2 is blocked by the currency 15 and so the amount of light received by the light-receiving devices S2*b* drops rapidly. As a result, the output from each optical sensor S2 decreases below a preset value L (step a4) at the timing t1 illustrated in FIG. 4. The preset value L corresponds to data obtained when the optical sensors S2 detect the front end of the currency 15. This preset value has been previously stored in the memory 5.

If the arrival of the front end of the currency 15 at the positions of the optical sensors S2 is confirmed, the microprocessor 1 begins to write data from the optical sensors S2 to a DATA2 file in the memory 5. Since the motor M continues to rotate, the currency 15 is detected by the sensors S2 while the currency is moving further forwardly through the conveyance passageway 14. The obtained data items are successively added to the data already held in the DATA2 file. This operation is continued while the optical sensors S2 keep detecting the paper currency 15 (steps a5 and a6). Data stored in the DATA2 file are obtained from dots arranged in rows and represent the transmissivities of various portions of the currency 15 which correspond to various concentrations or colors in the patterns on the currency 15.

If the rear end of the currency leaves the optical sensors S2, then the light from the light-emitting devices S2*a* of the optical sensors S2 is not blocked by the currency 15 at all; otherwise the light is slightly blocked by tape or cord attached to the currency. That is, the value indicating the output signal from the optical sensors S2 is no longer below the preset value L. Thus, it can be seen that this instant of time is the time at which the rear end of the paper currency 15 passes across the positions where the optical sensors S2 are installed.

If the front end of the currency 15 detected by the optical sensors S2 approaches and reaches the positions of the withdrawal-preventing levers 13, then the currency pushes the levers and, therefore, the sensors S3 begin to produce an output signal indicating detection of a paper currency.

If the result of the decision made in step a6 is that the rear end of the currency 15 has moved past the positions of the optical sensors S2, the microprocessor 1 stops the data from the optical sensors S2 from being written to the DATA2 file, and temporarily stops forward movement of the motor M, thus bringing conveyance of the paper currency 15 to a stop (step a7) at the timing t2 illustrated in FIG. 4.

The data stored in the DATA2 file and obtained from points arranged in rows is compared with reference data regarding the points, the reference data being already stored in the memory 5, to judge whether the paper currency 15 is genuine or counterfeit or to judge its kind (step a8). Immediately after the rear end of the currency 15 passes across the positions of the optical sensors S2, the rear end of the currency 15 has not yet reached the positions of the withdrawal-preventing levers 13. In this stage, therefore, any operation concerning introduction and return of the currency 15 is possible. If the result of the decision made in step a8 is that the currency 15 is bogus, then the microprocessor 1 reverses the motor M and returns the currency 15 by the same processing as conventionally performed (step a16).

On the other hand, if the paper currency 15 is a genuine money and the result of the decision made in step a8 is YES (Y), then the microprocessor 1 sets a timer into operation and waits for a given time to permit the data from the optical sensors S2 to be settled down (step a9). Then, the microprocessor 1 reads new data from the optical sensors S2 and writes it to a DATA3 register (second information storage means) (step a10) at the timing t2+t illustrated in FIG. 4.

Then, the microprocessor 1 makes a decision as to whether the data stored in the DATA3 register is approximate to the data previously stored in the DATA1 register in step a1. That is, the microprocessor makes a decision as to whether the data stored in the DATA3 register is below the product of the data stored in the DATA1 register and a coefficient $\alpha$, that is, DATA3>$\alpha$·DATA1 (step a11), such coefficient $\alpha$ being a predetermined value less than and close to 1.

If neither cord nor tape is attached to the paper currency, then it follows that the data stored in the DATA3 register is substantially equal to the data stored in the DATA1 register, as already described in connection with FIG. 8. As a result, DATA3$\alpha$>·DATA1 is realized. However, if cord or tape is attached to the currency, the cord or tape blocks the light impinging on the optical sensors S2 and so the data stored in the DATA3 register goes low, thus making a difference with the data stored in the DATA1 register. In consequence, DATA3$\leqq\alpha$·DATA1 is realized.

Accordingly, the microprocessor 1, confirming that neither tape nor cord is attached to the currency with the result of the decision made in step all as YES(Y), again rotates the motor M in a forward direction to start taking the currency 15 in. At the same time, the microprocessor 1 causes the timer to start counting time (step a12). The timer has been previously set at a time sufficient to take a paper current in.

If the result of a decision made in step a14 is YES (Y), i.e., a signal indicating an OFF state is produced from the lever sensors S3 before the timer generates a timeout signal (step a13; the result of decision is NO), then the micro-processor 1 recognizes that the currency 15 has been normally accepted and cannot be pulled out. Then, the microprocessor 1 stops the forward rotation of the motor M and produces a signal according to the kind of the currency 15, the signal indicating that the currency is genuine (step a15). Thus, a series of operations is ended.

If the signal indicating detection and produced from the lever sensors S3 does not assume an OFF state (step a13; the result of decision is YES) before the timer generates a timeout signal, then the microprocessor 1 recognizes that an unfair withdrawing operation is being attempted by the use of cord or tape which is attached to the currency but escaped being detected by the optical sensors S2. The microprocessor 1 then reverses the motor M and returns the currency 15 by the same processing as conventionally done (step a16). In this way, this series of operations is ended. Even if cord or tape 16 attached to the paper currency 15 passes between adjacent optical sensors S2 and escapes being detected by the optical sensors S2 by failing to block the light, the downstream withdrawal-preventing levers 13 detect such cord or tape 16 with certainty. In particular, the cord or tape 16 prevents any one of the levers 13 from being returned to its original position. That is, any one of the levers 13 does not go back to its original position within a given time (steps a13 and a15).

In the above embodiment, the insertion-detecting sensors S1 and the optical sensors S2 are of the transmission type. Instead, reflection type sensors receiving reflected light may be used. Also, in the above embodiment, the optical sensors S2 act as sensors for detecting passage of a paper currency and also as means for detecting data used for judging whether the currency is genuine and for judging the kind. The sensors for detecting passage of a currency may be made independent of the information detection means. In this case, numerous sensors are arranged across the conveyance passageway (i.e., perpendicular to the direction of currency insertion) so that tape or cord attached to the currency can be detected. Alternatively, a concave reflecting plate is mounted to one surface of the currency passageway which is opposite to the front or rear surface of the transported currency. Collimated light is projected in a direction perpendicular to the longitudinal direction of the conveyance passageway onto a region located ahead of the conveyance passageway. The light is reflected by the concave reflecting plate and focused at one point. The focused light is received by light-receiving devices. In this way, passage of the currency as well as a tape or cord, if present, is detected. Also, where passage-detecting sensors are installed independent of the information detection means, it is not always necessary to use the optical sensors as the information detection means. Means for magnetically extracting information from a paper currency may also be employed.

As described thus far, in the present invention, information DATA1 detected by the optical sensors S2 immediately before a paper currency is inserted into the currency-identifying apparatus is compared with information DATA3 obtained immediately after the currency passes across the optical sensors, so as to detect the presence or absence of tape or cord according to the difference therebetween. Therefore, the decision operation can be carried out more accurately without being affected by burning or contamination of the optical sensors S2. As a result, even if the difference providing the basis for the decision made as to whether tape or cord is present is set more strictly, i.e., the value of the coefficient $\alpha$ is set closer to 1, erroneous decision is less likely to take place. The apparatus can sufficiently cope with tape made of transparent vinyl or the like. Furthermore, in order to detect presence or absence of tape or cord, it is not necessary to form holes or slits or to add a mechanism, for example, for narrowing the currency passageway. Consequently, the inserted paper currency is prevented from stalling. In addition, the withdrawal-preventing levers are installed between the successive optical sensors S2 and so even if the optical sensors fail to detect tape, cord, or the like, it can be detected by the withdrawal-preventing levers. Hence, any unfair withdrawing operation can be prevented with greater certainty.

What is claimed is:

1. A paper currency-identifying apparatus for extracting data intrinsic to a paper currency transported through a currency conveyance passageway by the use of a currency information detection means and for making a decision as to whether said paper currency is genuine or counterfeit according to the extracted data, said apparatus comprising:

passage detection sensors facing said currency conveyance passageway to detect passage of said currency;

optical sensors facing said currency conveyance passageway to detect passage of said currency;

a first storage means for storing data obtained from said optical sensors immediately after said currency is detected by said passage detection sensors and before said currency is detected by said optical sensors;

a second storage means for storing data obtained from said optical sensors after said passage detection sensors cease to detect said currency; and a decision means for making a decision according to the data stored in said first storage means and according to the data stored in said second storage means as to whether a tether is attached to said currency carried through said currency conveyance passageway.

2. The currency-identifying apparatus of claim 1, wherein said decision means has a means for calculating a ratio of the data stored in said first storage means to the data stored in said second storage means, comparing the calculated ratio with a preset value, and making a decision according to a result of the comparison as to whether a tether is attached to said currency.

3. The currency-identifying apparatus of claim 1, wherein said optical sensors act also as said currency information detection means.

4. The currency-identifying apparatus of claim 1, further comprising:

withdrawal-preventing levers capable of being moved in a retracting direction by said currency being conveyed through said currency conveyance passageway in a direction of currency insertion, said withdrawal-preventing levers being incapable of being moved in a retracting direction by said currency being pulled through said currency conveyance passageway in a direction opposite to said direction of currency insertion, said withdrawal-preventing levers protruding into said currency conveyance passageway when no currency is adjacent said withdrawal-preventing levers, and means for sensing that said withdrawal-preventing levers are in their retracted state.

5. The currency-identifying apparatus of claim 4, wherein said withdrawal-preventing levers are arranged across said currency conveyance passageway.

6. The currency-identifying apparatus of claim 1, wherein each of said optical sensors consists of a combination of a light-emitting device and a light-receiving device which are mounted on opposite sides of said currency conveyance passageway.

7. The currency-identifying apparatus of claim 1, wherein each of said optical sensors consists of a combination of a light-emitting device facing said currency conveyance passageway and a light-receiving device for receiving light reflected by an object existing in said currency conveyance passageway.

8. The currency-identifying apparatus of claim 6 or 7, wherein said optical sensors form plural sets arranged across said currency conveyance passageway.

* * * * *